US007201342B2

(12) United States Patent
Huang

(10) Patent No.: US 7,201,342 B2
(45) Date of Patent: Apr. 10, 2007

(54) SIGNAL CABLE REWINDER WITH TWO REWINDING DISCS

(76) Inventor: Chien-Pin Huang, 7F, #13, Lane 222, Tun Hua N. Rd., Taipei (TW)

( * ) Notice: Subject to any disclaimer, the term of this patent is extended or adjusted under 35 U.S.C. 154(b) by 0 days.

(21) Appl. No.: 10/791,766

(22) Filed: Mar. 4, 2004

(65) Prior Publication Data

US 2005/0194486 A1 Sep. 8, 2005

(51) Int. Cl.
*B65H 75/48* (2006.01)

(52) U.S. Cl. ..... 242/378.2

(58) Field of Classification Search ..... 242/378, 242/378.1, 378.2, 378.3, 378.4; 191/12.2 R, 191/12.2 A, 12.4
See application file for complete search history.

(56) References Cited

U.S. PATENT DOCUMENTS 1,451,300 A * 4/1923 Helman ..... 242/378.4
1,663,083 A * 3/1928 Kavle ..... 242/378.4
2,776,644 A * 1/1957 Fontaine
4,502,226 A * 3/1985 Hung ..... 242/378.4
4,773,623 A * 9/1988 Nabinger
5,669,571 A * 9/1997 Graybill ..... 242/378.1
5,762,281 A * 6/1998 Foley
6,199,784 B1 * 3/2001 Wang et al. ..... 242/378
6,416,005 B1 * 7/2002 Liao ..... 242/378.1
6,497,378 B1 * 12/2002 Liao ..... 242/378.1
6,866,219 B2 * 3/2005 Wei ..... 242/378.4
2004/0200920 A1 * 10/2004 Wei ..... 242/378.4

* cited by examiner

*Primary Examiner*—William A. Rivera
(74) *Attorney, Agent, or Firm*—Troxell Law Office, PLLC

(57) ABSTRACT

The invention relates to a signal cable rewinder having two opposing housings in which two independently rewinding discs are disposed. Each of two signal cables is folded once in the middle thereof to form a double-folded member that is wounded around the rewinding disc. Both ends of the first signal cable are extended out of the openings of the housings, respectively. In pressing down a release button, the signal cable can be pulled out in operation position. Thus, two independently retractable and extendable signal cables are accommodated in a single housing for an easy use, a convenient storage and for reducing the manufacturing cost.

4 Claims, 5 Drawing Sheets

SIGNAL CABLE REWINDER WITH TWO REWINDING DISCS

BACKGROUND OF THE INVENTION

1. Field of the Invention

The invention relates to a signal cable rewinder with two rewinding discs, and more particularly, to an apparatus with two rewinding discs for winding signal cable back into a cable cassette. Meanwhile, both ends of each of the cables are fitted with a plug of the same specifications for facilitating the use of the signal cables.

2. Description of the Related Art

With the popularization and the development of the computer, communication and consumer electronics industries (3C-industries), signal cables of different functions, dimensions and forms have been widely employed to connect different peripherals. However, it's still problematic to store the extended signal cables (e.g. mouse cable, earphone cable, etc.) with two connectors at their ends, and more particularly for the notebook-users making business trip.

Most of the conventional signal cable rewinders employs a cable disc in connection with a spiral spring within a cable cassette. The cable is wounded around the cable disc. One distal end of the signal cable within the cassette is secured by a retaining device for imparting motion to the cable disc. Meanwhile, the cable disc is connected with a positioning and retracting mechanism. In use, the signal cable is pulled out for a certain length to rotate the spiral spring while the cable is locked in operation position by the positioning and retracting mechanism. In retracting the signal cable, the cable is rewound by the resilience of the spiral spring back to the cable disc. Although this can achieve the purpose of convenient use, it still has following drawbacks:

1. One cable cassette can receive only one signal cable. It will be much inconvenient and uneconomical to prepare several cable cassettes for meeting the various needs of signal transmission.
2. The retaining device of the conventional cable rewinder employs a fixed contact point to be in connection with a connection cord beyond the cable cassette. Meanwhile, the inner end of the signal cable is joined to a mobile contact point movable with the cable disc such that a constant connection between the fixed and mobile contact point is established when the mobile contact point moves. However, the fixed and mobile contact point are subject to pressure and friction and, therefore, cause bad contact.
3. The conventional signal cable can be too long and, therefore, the spiral spring can be over-distorted. This will easily cause the fatigue of the spring.

SUMMARY OF THE INVENTION

In light of the demerits of the prior art, the invention provides a signal cable rewinder that aims to ameliorate at least some of the disadvantages of the prior art or to provide a useful alternative.

A primary objective of the invention is to provide a signal cable rewinder having two opposing housings in which two independently rewinding discs are disposed. The cable is rewound around the rewinding disc. The independent rewinding disc can be released by a release button to pull out the cable in operation position. Thus, two independently retractable and extendable signal cables are accommodated in a single housing for an easy use, a convenient storage and for reducing the manufacturing cost.

Another object of the invention is to provide a signal cable rewinder having two signal cables each of which is folded once in the middle thereof to form a double-folded member that is wounded around the rewinding disc. Both ends of the signal cables are outwardly extended from two openings on the surface of the housings. In use, both ends of the cable are pulled out so that the cable is pulled out twice the rotation distance of the cable disc. Accordingly, the problem with the fatigue of the spring can be avoided to a great extent.

A further object of the invention is to provide a signal cable rewinder having two signal cables that are located outside the housings. Unlike the conventional structure that requires a fixed contact point in cooperation with a mobile contact point to establish a mobile connection, the signal cable rewinder in accordance with the invention doesn't have the problem with the bad contact due to the wearing action on the fixed contact point and the mobile contact.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
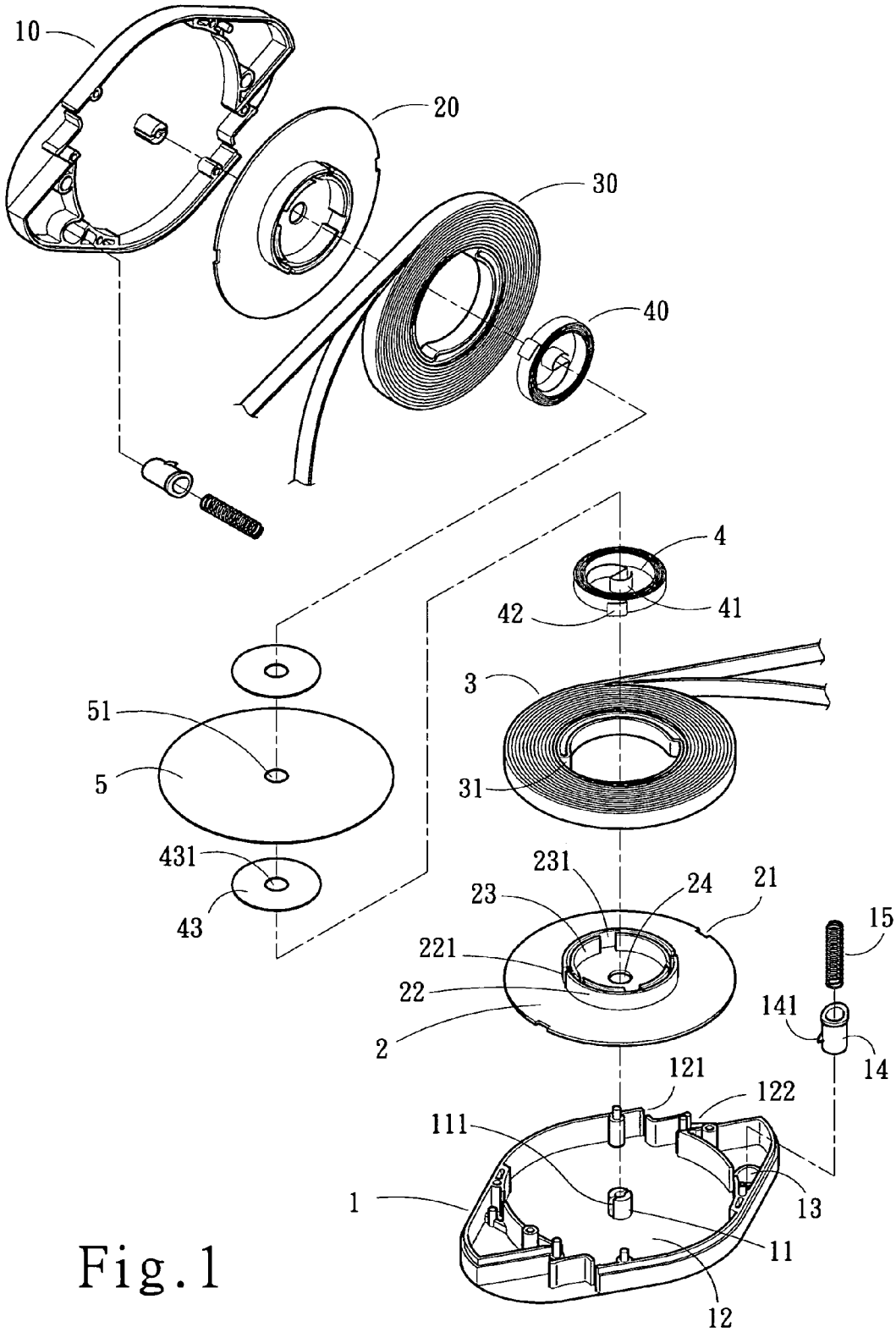
FIG. 1 is an exploded view of the signal cable rewinder of the invention.
Figure 2:
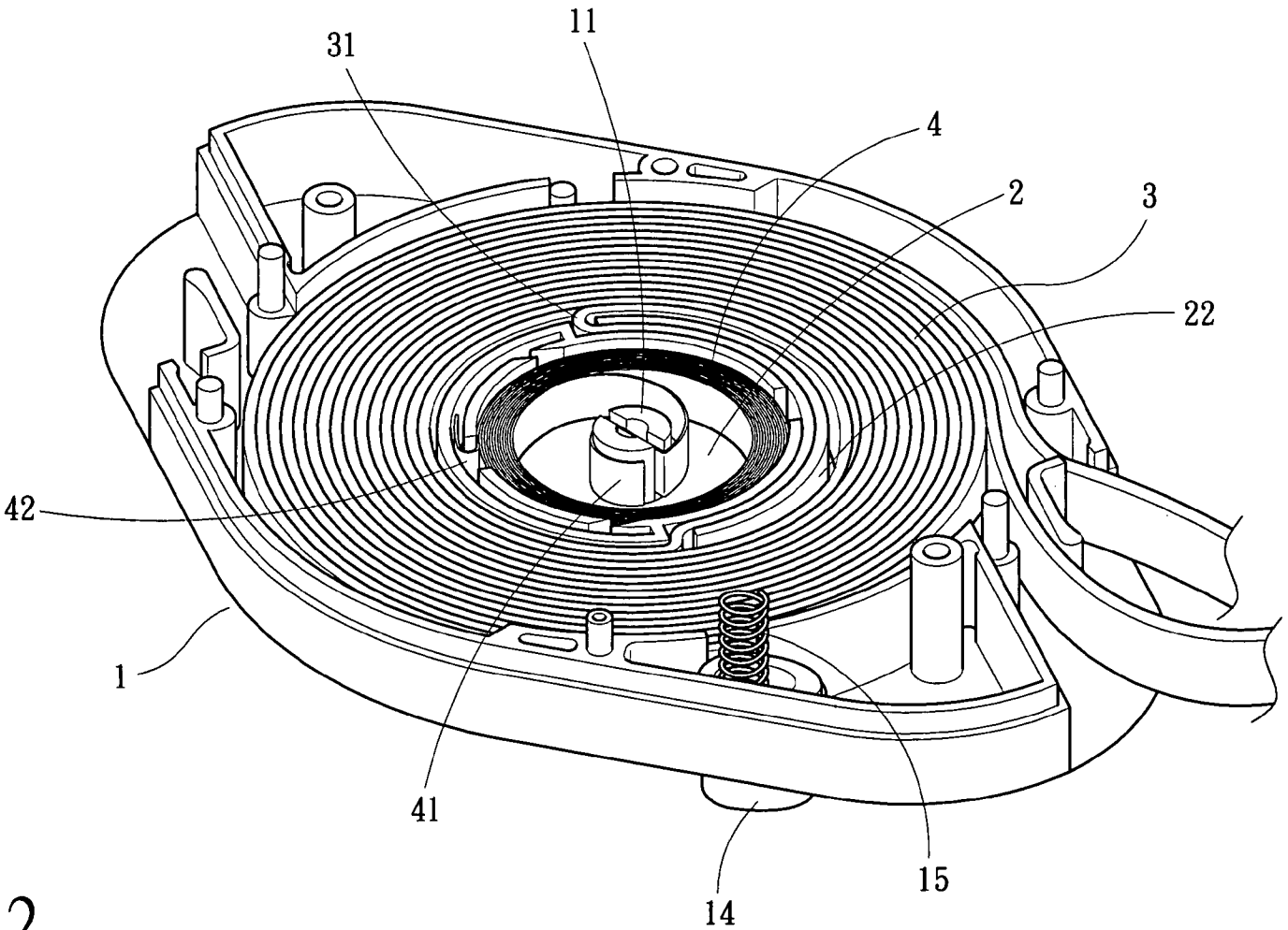
FIG. 2 is a perspective view of the signal cable rewinder of the invention after partial assembly.
Figure 3:
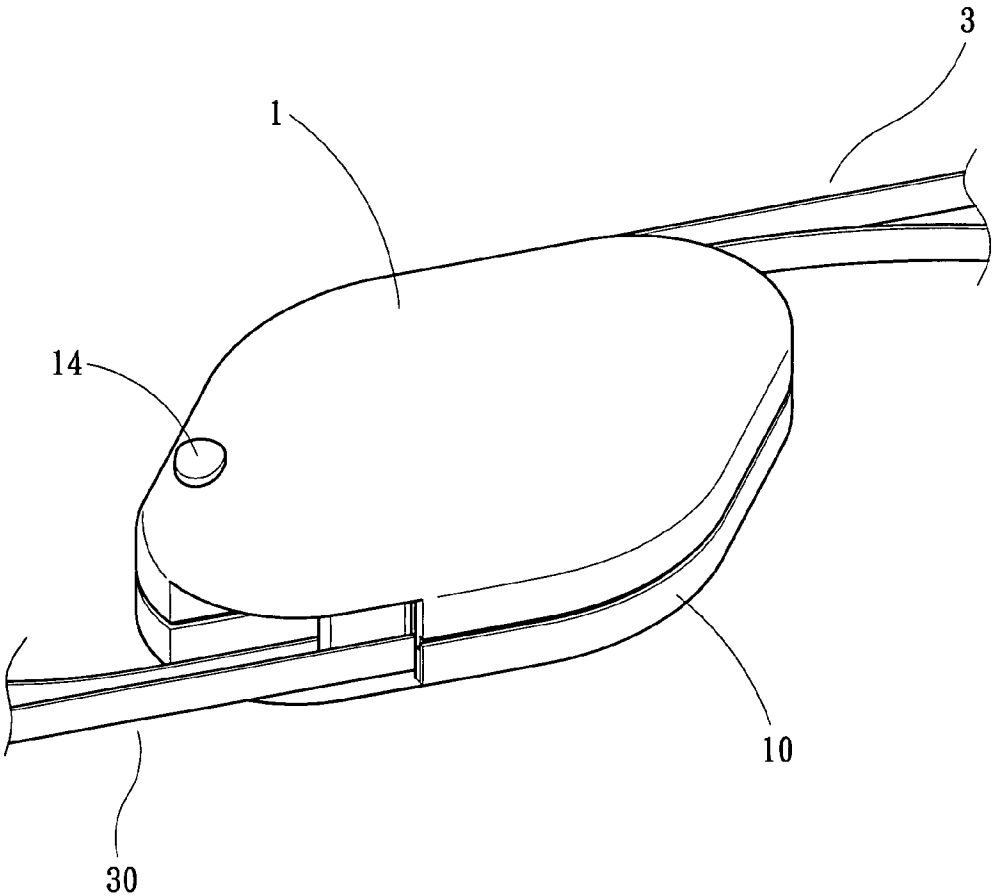
FIG. 3 is a perspective view of the signal cable rewinder of the invention after full assembly.

First of all, referring to FIGS. 1 through 3, the signal cable rewinder in accordance with the invention includes two opposing housings 1, 10, two rewinding discs 2, 20, two signal cables 3, 30, two spiral springs 4, 40 and a central partition 5.

The center of the lower housing 1 has a pivot 11 with an axial slot 111. A cable chamber 12 of the lower housing 1 is formed around the pivot 11. The lower housing 1 includes two adjacent openings 121, 122 and a through hole 13. A release button 14 with a compression spring 15 is received in the through hole 13 while the distal end of the release button 14 protrudes from the through hole 13. Moreover, a projection 141 is formed on the outer wall of the release button 14.

The center of the first rewinding disc 2 includes a pivot hole 24 for receiving the pivot 11 of the lower housing 1 to establish a rotatable connection. A plurality of fixing rings 22, 23 of different diameters are disposed on the first rewinding disc 2 around the pivot hole 24. The fixing rings 22, 23 include a plurality of grooves 221, 231. Besides, The rim of the first rewinding disc 2 is formed with a plurality of indentations 21 into which the projection 141 of the release button 14 engages.

The first signal cable 3 is folded once in the middle thereof to form a double-folded member 31 that passes through the groove 231 of the internal ring 23 and comes out of another groove 221 of the external ring 22 of the first rewinding disc 2. Thereafter, the first signal cable 3 is wounded around the external ring 22 and both ends of the first signal cable 3 are extended out of the openings 121, 122, respectively.

The first spiral spring 4 is disposed within the fixing rings 22 of the first rewinding disc 2. The center thereof includes an internal hook 41 that is hooked in the axial slot 111 of the pivot 11 and an external hook 42 that is hooked in the groove 231 of the internal ring 23 of the first rewinding disc 2. A spring-compressing disc 43 is mounted on the top of the first spiral spring 4 and has a central hole 431 allowing for insertion of the pivot 11 of the lower housing 1 in place.

The central partition 5 has a central hole 51 allowing for insertion of the pivot 11 of the lower housing 1 and is arranged on the top of the first signal cable 3.

The upper housing 10, the second rewinding disc 20, the second signal cable 30 and the second spiral springs 40 correspond to the lower housing 1, the first rewinding disc 2, the first signal cable 3 and the first spiral spring 4 in their structure, respectively. Therefore, no further descriptions thereto are given hereinafter.

In performing the assembly of the invention, the half-finished product of the assembly of the lower housing 1, the first rewinding disc 2, the first signal cable 3 and the first spiral spring is joined to the half-finished product of the assembly of the upper housing 10, the second rewinding disc 20, the second signal cable 30 and the second spiral springs 40 with the central partition 5 fitted therebetween. In this way, the two sets of signal cable 3, 30 are operable in an independent way.

Figure 4A:
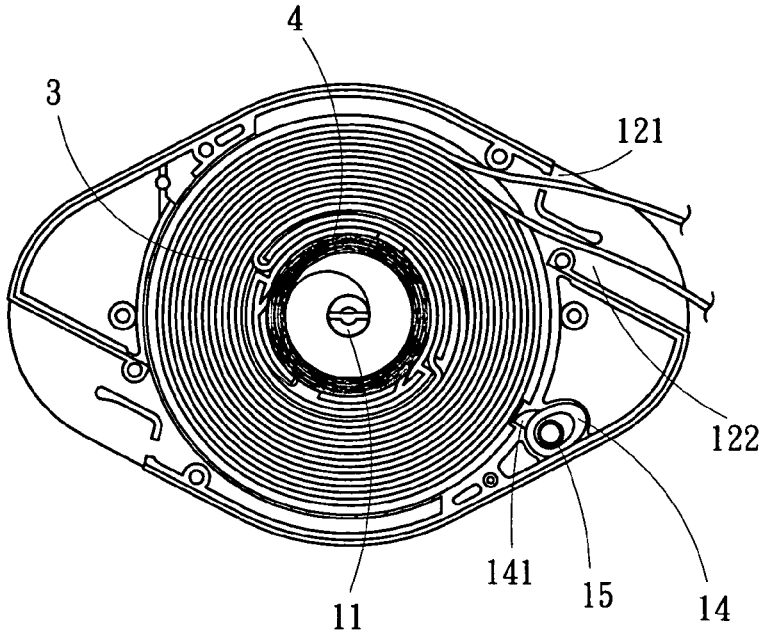
FIG. 4A is a schematic drawing of the invention with the relative action of the rewinding disc and the spiral spring when the projection of the release button engages into an indentation of the first rewinding disc.
Figure 4B:
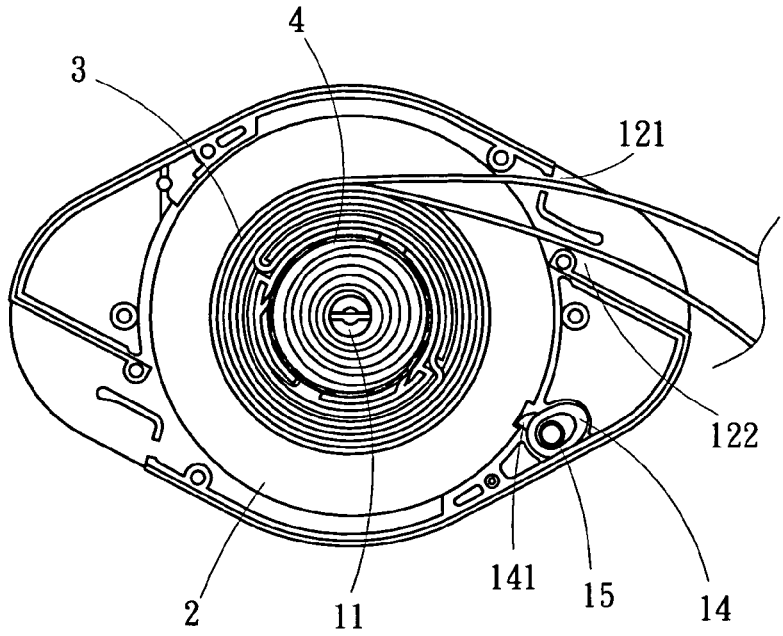
FIG. 4B is a schematic drawing of the invention with the relative action of the rewinding disc and the spiral spring when the projection of the release button is removed from the indentation of the first rewinding disc.
Figure 5A:
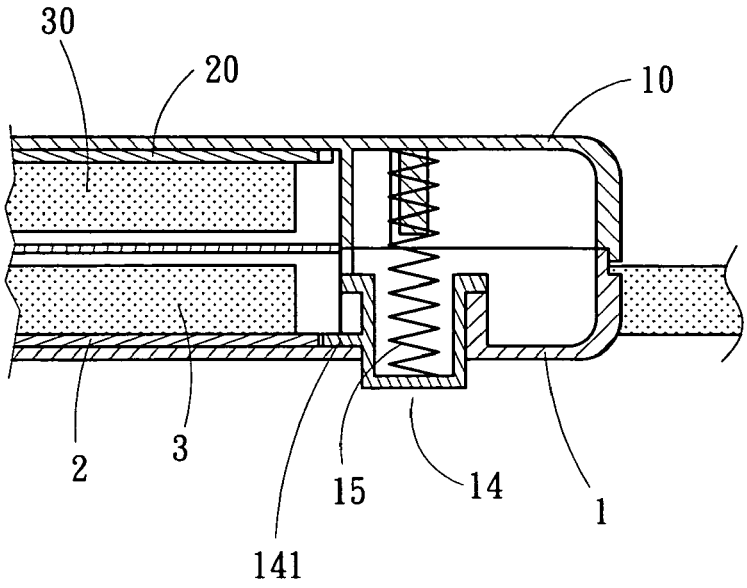
FIG. 5A is a schematic drawing of the invention with the relative action of the rewinding disc and the release button when the projection of the release button engages into an indentation of the first rewinding disc.
Figure 5B:
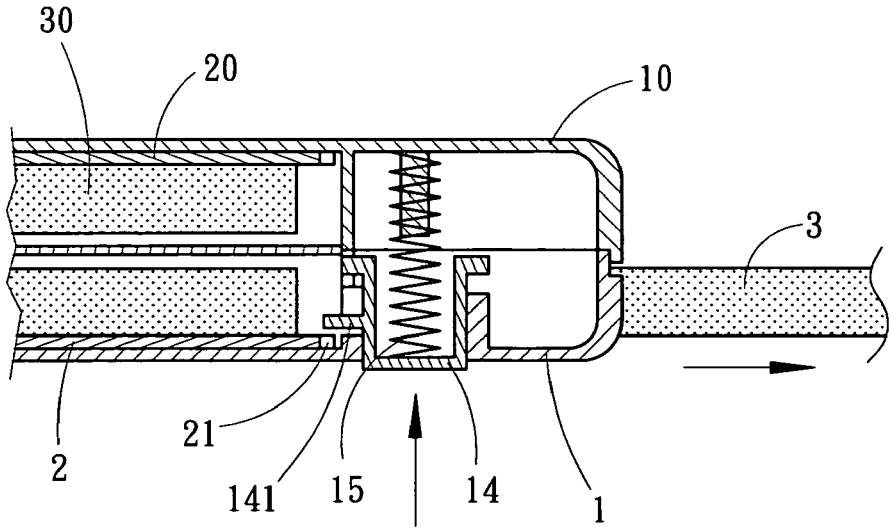
FIG. 5B is a schematic drawing of the invention with the relative action of the rewinding disc and the release button when the projection of the release button is removed from the indentation of the first rewinding disc.

When the first signal cable 3 is completely wound around the fixing rings 22 of the first rewinding disc 2, the projection 141 of the release button 14 engages into the indentations 21 of the first rewinding disc 2 for locking the first rewinding disc 2 in a storage position (see FIGS. 4A and 5A). In use, the release button 14 is pressed down, the projection 141 is removed from the indentations 21 (see FIG. 5B) to release the first rewinding disc 2. At that time, both ends of the first signal cable 3 can be pulled out and the first rewinding disc 2 is moved with this pull action so that the first spiral spring 4 is pulled in tensioned state. Thereafter, the release button 14 (that restores itself back to its original position by the resilience of the compression spring 15) and the first signal cable 3 are released, and the first rewinding disc 2 is rotatable by the resilience of the first spiral spring 4 until the projection 141 of the release button 14 engages into the indentations 21 of the first rewinding disc 2 in operation position (see FIG. 4B). Accordingly, the signal cable is available for use. In addition, the first spiral spring 4 now is still distorted to a certain extent. When the release button 14 is pressed down again, the projection 141 of the release button 14 is removed from the indentation 21 of the first rewinding disc 2. By use of the resilience of the first spiral spring 4, the first rewinding disc 2 is rotatably returned and the first signal cable 3 can be completely wounded in its original position, as shown in FIGS. 4A and 5A.

Accordingly, the accommodation chamber formed by the lower housing 1 and the upper housing 10 receives two independent signal cables 3, 30 that can be outwardly pulled and rewound. This allows for a practical use and storage. Moreover, both ends of the signal cables 3, 30 can be pulled at the same time, thereby achieving a convenient use.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A signal cable rewinder comprising:

a) a housing including two housing members;

b) two rewinding discs, each of the two rewinding discs has a plurality of fixing rings, one of the two rewinding discs is located on an interior of each of the two housing members;

c) two spiral springs, each of the two springs has a first spring end and a second spring end, the first spring end of one of the two spiral springs is connected to each of the two housing members, the second spring end of one of the two spiral springs is connected to each of the two rewinding discs; and d) two signal cables, each of the two signal cables has a middle portion and is folded at the middle portion forming a double-folded member, the middle portion of one of the two signal cables is wound around a plurality of grooves of the plurality of fixing rings of each of the two rewinding discs, one double-folded member is wound around each of the two rewinding discs, wherein opposing ends of one of the two signal cables are simultaneously withdrawn from and retracted into each of the two housing members, the two signal cables are independently withdrawn from and retracted into the housing.

2. The signal cable rewinder according to claim 1 further comprising two release buttons and two compression springs, each of the two release buttons has a projection, each of the two rewinding discs has a plurality of indentations formed in an outer periphery thereof, each of the two housing members has a through hole, one of the two release buttons is inserted into each through hole, each of the two release buttons is movable between locked and depressed positions, wherein, when a selected button of the two release buttons is located in the locked position, one of the two compression springs pushed the selected button outwardly from the housing and one of the plurality of indentations engaging the projection, and, when the selected button of the two release buttons is located in the depressed position, the selected button is pressed inwardly toward an interior of the housing compressing one of the two compression springs, and the plurality of indentations are separated from the projection.

3. The signal cable rewinder according to claim 2 further comprising a central partition located in the interior of the housing separating a first rewinding disc of the two rewinding discs and a first cable of the two signal cables from a second rewinding disc of the two rewinding discs and a second cable of the two signal cables.

4. The signal cable rewinder according to claim 1 further comprising a central partition located in the interior of the housing separating a first rewinding disc of the two rewinding discs and a first cable of the two signal cables from a second rewinding disc of the two rewinding discs and a second cable of the two signal cables.

* * * * *